US010839676B2

(12) United States Patent
Churilla et al.

(10) Patent No.: US 10,839,676 B2
(45) Date of Patent: Nov. 17, 2020

(54) APPARATUS AND METHOD FOR ALARM PANEL WIFI ALARM AUDIO VERIFICATION CONNECTIVITY TEST

(71) Applicant: Ademco Inc., Golden Valley, MN (US)

(72) Inventors: Chad Churilla, Nesconset, NY (US); Michael Everald Barrett, Freeport, NY (US); Raymond J. Jordan, Holtsville, NY (US); Eliran Noach, Roslyn Heights, NY (US)

(73) Assignee: Ademco Inc., Golden Valley, MN (US)

( * ) Notice: Subject to any disclaimer, the term of this patent is extended or adjusted under 35 U.S.C. 154(b) by 73 days.

(21) Appl. No.: 14/319,375

(22) Filed: Jun. 30, 2014

(65) Prior Publication Data

US 2015/0356865 A1 Dec. 10, 2015

Related U.S. Application Data

(60) Provisional application No. 62/008,284, filed on Jun. 5, 2014.

(51) Int. Cl.

| | |
|---|---|
| ***G08B 29/14*** | (2006.01) |
| ***G08B 25/01*** | (2006.01) |
| ***G08B 25/00*** | (2006.01) |

(52) U.S. Cl.

CPC ..... *G08B 29/14* (2013.01); *G08B 25/006* (2013.01); *G08B 25/014* (2013.01)

(58) Field of Classification Search

CPC ..... G08B 29/14; G08B 17/06; G08B 29/145; G08B 29/12; G08B 25/14

USPC .... 340/5.1, 6.1, 3.71, 501, 506, 514, 870.09

See application file for complete search history.

(56) References Cited

U.S. PATENT DOCUMENTS

| | | | | |
|---|---|---|---|---|
| 6,624,750 | B1 * | 9/2003 | Marman | G08B 25/003 340/4.3 |
| 7,042,349 | B2 * | 5/2006 | Bergman | G08B 25/003 340/514 |
| 8,565,125 | B2 | 10/2013 | Blum et al. | |
| 2004/0113778 | A1 * | 6/2004 | Script | G01P 13/00 340/545.1 |
| 2004/0119778 | A1 * | 6/2004 | Naito | B41J 19/202 347/37 |
| 2005/0030179 | A1 * | 2/2005 | Script | G08B 13/08 340/545.1 |
| 2005/0203647 | A1 | 9/2005 | Landry et al. | |
| 2006/0073822 | A1 * | 4/2006 | Orton | H04L 41/0627 455/423 |
| 2006/0103520 | A1 * | 5/2006 | Clark | G08B 29/123 340/506 |

(Continued)

FOREIGN PATENT DOCUMENTS

| | | |
|---|---|---|
| EP | 2 282 503 A2 | 2/2011 |

OTHER PUBLICATIONS

Extended European search report for corresponding EP application 15167705.1, dated Aug. 28, 2015.

*Primary Examiner* — Hai Phan
*Assistant Examiner* — Anthony D Afrifa-Kyei
(74) *Attorney, Agent, or Firm* — Fredrikson & Byron, P.A.

(57) ABSTRACT

A system and method which provide alarm audio verification testing in connection with a regional monitoring system operate in parallel with a local system control panel, or unit. The testing capability functions in a standalone mode relative to the monitoring system, and, can implement a test without causing a false alarm detectable by the panel.

15 Claims, 5 Drawing Sheets

(56) References Cited

U.S. PATENT DOCUMENTS

| | | | | |
|---|---|---|---|---|
| 2011/0065414 | A1 | 3/2011 | Frenette et al. | |
| 2011/0102171 | A1 | 5/2011 | Raji et al. | |
| 2011/0254681 | A1* | 10/2011 | Perkinson | G08B 25/14 340/506 |
| 2012/0139718 | A1* | 6/2012 | Foisy | G08B 25/012 340/531 |
| 2013/0246850 | A1* | 9/2013 | Gelter | G08B 29/12 714/32 |

* cited by examiner

APPARATUS AND METHOD FOR ALARM PANEL WIFI ALARM AUDIO VERIFICATION CONNECTIVITY TEST

CROSS-REFERENCE TO RELATED APPLICATION

This application claims the benefit of the filing date of U.S. Provisional Application Ser. No. 62/008,284 filed Jun. 5, 2014, entitled, "Apparatus and Method for Alarm Panel WIFI Alarm Audio Verification Connectivity Test". The '284 application is hereby incorporated herein by reference.

FIELD

The application pertains to systems and methods of conducting alarm audio verification tests. More particularly, the application pertains to such systems and methods which operate in parallel with local monitoring system control units, or panels and which do not cause alarm conditions.

BACKGROUND

It is known to use an alarm forwarding network to provide verbal communications between a regional monitoring system and a displaced central monitoring station. Such networks, for example, the ALARMNET alarm forwarding system, can include a server to implement wireless verbal communications via the Internet. One such system is disclosed and described in U.S. Pat. No. 8,565,125 B2 entitled Services Based Two Way Voice Service Recoding and Logging, which issued Oct. 22, 2013 and is assigned to the assignee hereof. The '125 patent is hereby incorporated by reference herein.

Alarm systems with a WIFI pathway are known to utilize SIP and STUN functionality, discussed below, for alarm audio verification (AAV). Session Initiation Protocol (SIP) is an internet telephony control protocol. Session Traversal Utilities for Nat (STUN) enables an end host to discover its public IP address. Real-time Transport Protocol (RTP) is a standardized protocol for transmitting and receiving audio data over the internet.

However, it is unknown at install time whether the panel owner possesses a compatible network topology or the bandwidth requirements necessary to perform AAV. Previously, to verify the compatibility of the panel owner's network topology and to verify the necessary bandwidth, it was required that an owner or installer contact a central station and coordinate a live panic alarm such that the police would not be dispatched if the call were to fail. Furthermore, if the user moves their panel from one location to another location, or changes their network hardware or provider, they would have to repeat these steps each time.

With respect to the above noted problems, testing AAV puts a timely and difficult burden upon installers as well as central stations since it requires installers to be in constant coordination with their central stations so that upon creating an AAV condition, if the call were to fail or be of inadequate quality to deem as a false alarm, police would be dispatched in error.

SIP and RTP, by themselves, cannot work within or behind certain network environments, specifically behind some Network Address Translation (NAT) devices. To combat that insufficiency, Session Traversal Utilities for NAT (STUN) was developed. However, behind certain network environments, STUN is unable to perform its duties thereby rendering SIP or RTP inoperative. In other words: SIP and RTP are generally contingent upon STUN and STUN may fail within certain network topologies, thereby contributing to the above problem.

Given the nature of AAV, it is important that AAV meet or exceed a certain standard of quality. Conversely, the quality of SIP and RTP is subjective and many of the elements contributing to their quality are unknown to end users and alarm system installers before use. This makes it difficult to predict the quality or outcome of SIP or RTP beforehand making it difficult to predict the quality of AAV before using it.

DETAILED DESCRIPTION

Figure 1:
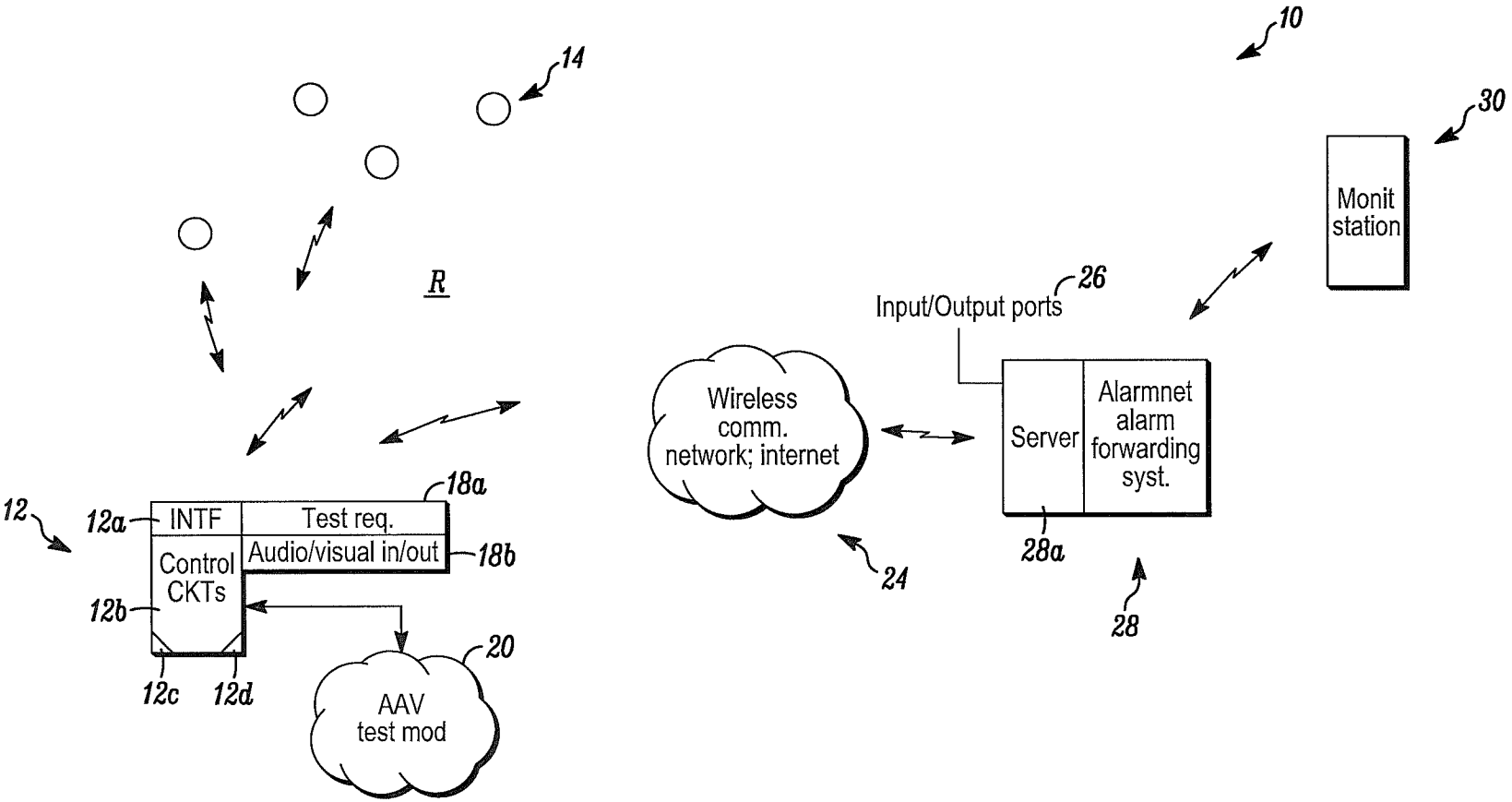
FIG. 1 illustrates a block diagram of a system in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

An alarm audio verification system and method are described subsequently, in conjunction with a high speed internet connection, using SIP, RTP, and STUN.

In one aspect, an alarm system in accordance herewith provides a WIFI alarm audio verification test. This test will enable a panel owner to initiate a test process. This can be by pressing a button, touching a screen or making an oral request, without limitation. This request will connect a call to an alarm forwarding network, for example the ALARMNET network.

The user is able to listen to a phrase, record a phrase, and playback their recording, to verify both that the call was connected and was of acceptable quality. This is all done without causing an alarm condition, thereby obviating the need for coordination with a monitoring, or, central station. It can be done at any time, and as such facilitates easy future testing as conditions change, as described earlier.

The alarm system WIFI AAV test capability has been designed such that it can function in a standalone mode relative to the security system. Normally, when the WIFI AAV test is performed, the information needed for the call is provided with the alarm acknowledgment. However, because the WIFI AAV test capability is implemented as a standalone, another mechanism has been provided that dials a special phone number and contacts a special voip server ip coupled to an input port. As a result, there's no need to create an alarm to start the call.

Because this phone number, ip, and port have been reserved for testing purposes only, an automated response will be played. Ten seconds of audio can then be recorded, and, that ten seconds of audio will be replayed to help verify call quality. While this process is being carried out, the panel can continue to function normally, without compromising the integrity or functionality of the security system.

FIG. 1 illustrates a system 10 in accordance herewith. In system 10, a control unit 12 and a plurality of condition detectors 14 monitor a region R. Sensors 14 can include, for example, motion detectors, glass break detectors, smoke fire, or gas detectors all without limitation. Such detectors can be in wired or wireless communications with the control unit, or panel, 12.

Control unit 12 can include a wired and/or wireless interface 12*a*, and control circuits 12*b*. Circuits 12*b* can be implemented, at least in part by a programmable processor 12*c* and associated, executable control instructions, or software, executable by the processor 12*c*.

Control unit 12 could also include a test request button, touch screen or audible input device such as illustrated at 18*a*. An audio/visual input/output device or unit 18*b* can receive audio inputs from a tester, and output audio, or visual feedback as at 18*b*.

An AAV test module 20 can be associated with unit 12. The module 20 can be an integral part of the unit 12, or can be an add-on which is coupled to the unit 12 all without departing from the spirit and scope hereof.

A tester, or installer, can initiate an AAV test via input device 18*a*. In response thereto test module 20 communicates wirelessly via a wireless communication network, such as the Internet, 24 with multiple test and communications ports 26, at a predetermined address, phone number or URL without limitation. The ports 26 are coupled to a displaced server of an alarm forwarding network 28, for example, the ALARMNET alarm forwarding system. The forwarding system communicates with a displaced monitoring station 30. The monitoring station 30 can receive alarm indicating messages from the forwarding system 28 directly, or, via the Internet 24.

In response to an AAV request received at one of the test ports 26, the system 28, via server 28*a*, can transmit a pre-established confirmatory message which is then presented visually or audibly at output device 18*b* to confirm for the tester that the requested test is underway.

The tester can then input a verbal message at input/output 18*b*. This message is transmitted via the network 24 to one of the test ports 26 where it is returned, via server 28*a*, to the input/output unit 18*b* to be audibly or visually presented to the tester. If an audible output, the tester can evaluate the quality of the audio and confirm that the communications link is active and operational while the control unit 12 continues to function independently and to carry out it's monitoring functions.

Figure 2:
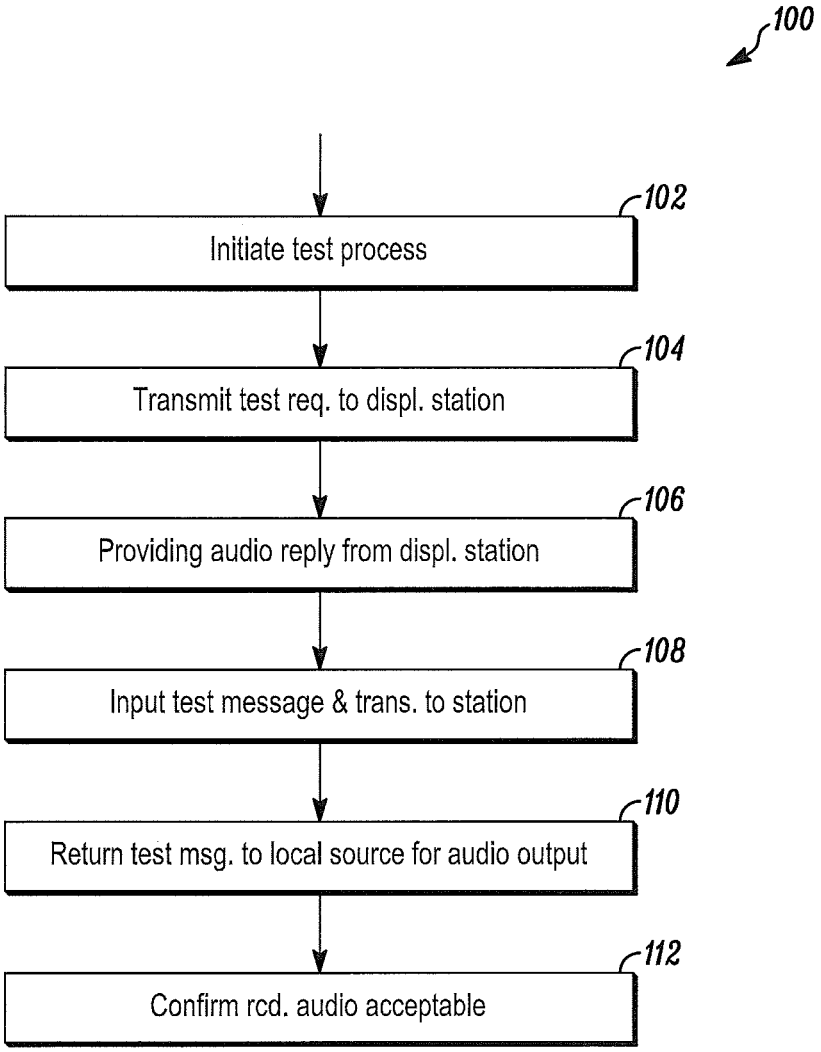
FIG. 2 is a flow diagram illustrating aspects of a method in accordance herewith.

An implementation process 100, is illustrated in FIG. 2. An AAV test process is initiated, as at 102, via the test request device 18*a*. The test request is wirelessly transmitted to a displaced monitoring station 28, as at 104.

The system 28 transmits a pre-established, or pre-stored audio or visual reply, as at 106, to the output device 18*b*. The tester can then input a test message, at unit 18*b*, which is transmitted to the monitoring station 28, as at 108.

The test message is then returned by the server 28*a*, via network 24 to the output device 18*b* where the tester can evaluate the quality of the audio connection, as at 110. The test could if desired confirm receipt of the returned audio message and optionally indicate that the audio connection is acceptable, as at 112.

Figure 3:
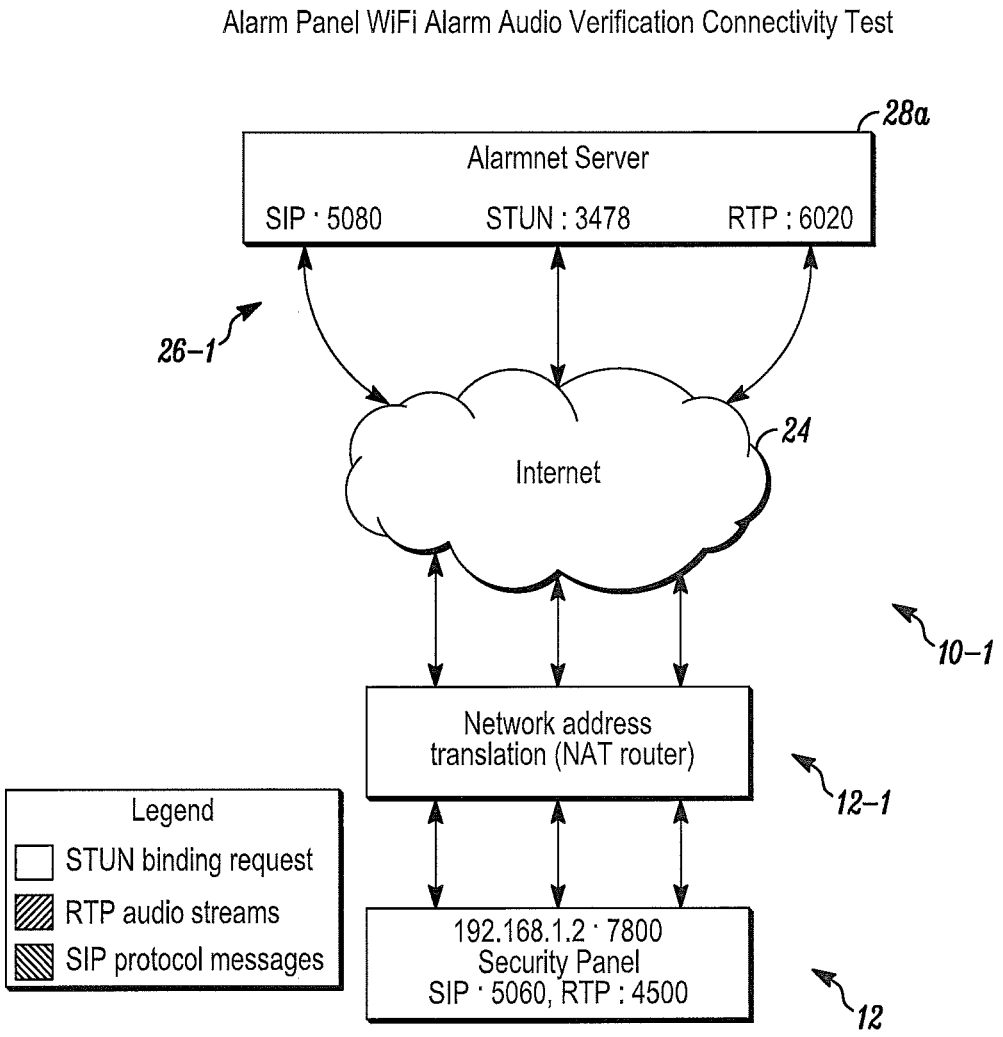
FIG. 3 illustrates additional aspects of the system of FIG. 1.

FIG. 3 illustrates details of a system 10-1 in accordance herewith. In FIG. 3, control panel 12 communicates via the Internet 24 with the ALARMNET network server 28*a* via multiple bidirectional ports 26-1 to implement the above processing, illustrated in FIG. 2.

As will be understood by those of skill in the art, an address translation function can be provided by a NAT router 12-1. Three ports are provided at server 28*a*, namely, 5080, 3478 and 6020 for SIP, STUN and RTP communications.

Figure 4:
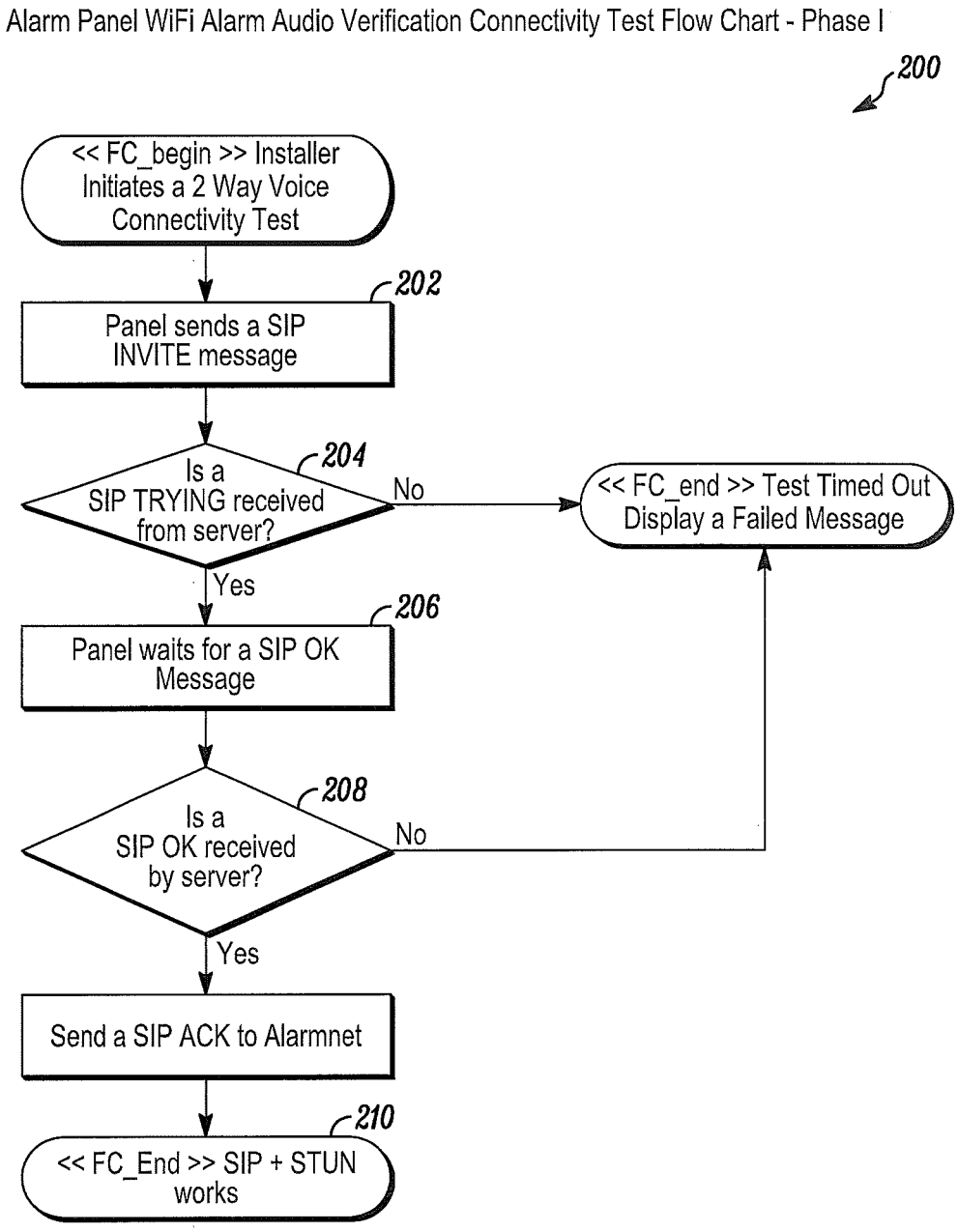
FIG. 4 is a flow diagram which illustrates aspects of an embodiment of a method in accordance herewith.
Figure 5:
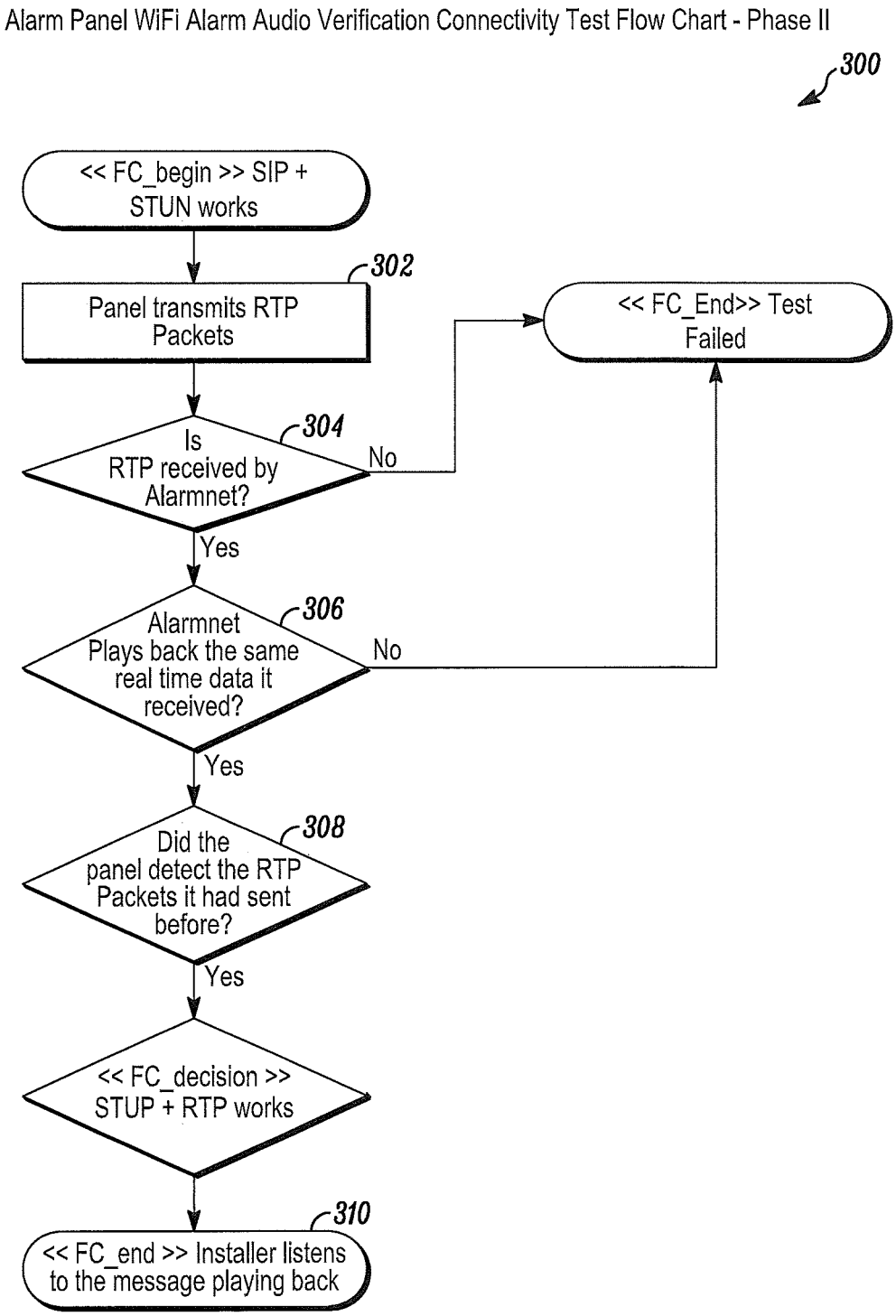
FIG. 5 is a flow diagram that illustrates additional aspects of an embodiment in accordance herewith.

FIGS. 4, 5 illustrate additional processing details. In FIG. 4, in process 200, once a Voice Connectivity Test is initiated, SIP provides signaling and call set up via port 5080. A SIP INVITE message is forwarded to port 5080 as at 202. If a SIP TRYING code is received from the ALARMNET server, as at 204, the panel 12 waits for a SIP OK message as at 206. If a SIP OK is received by the server as at 208, a SIP ACK is sent to the ALARMNET server, as at 210.

FIG. 5 illustrates aspects of process 300 which takes place in response to a successful process 200, described above. Message packets are transmitted, as at 302, to the ALARMNET server via port 6020. Where the transmission is successful, as at 304, the ALARMNET server plays back the received real time data via port 6020 as at 306.

If the panel 12 detects the same packets as it had sent before, as at 308, the message is audibly played for the installer, as at 310, who can evaluate the quality and acceptability thereof.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. An apparatus comprising:

a monitoring system control device coupled to a plurality of condition monitoring sensors;

a displaced alarm forwarding system remotely located from the monitoring system control device and the plurality of condition monitoring sensors;

a network enabled alarm audio verification test unit associated with the monitoring system control device that initiates test communications with the displaced alarm forwarding system to initiate a two-way verbal test; and a monitoring station that receives alarm communications from the displaced alarm forwarding system when one of the plurality of condition monitoring sensors detects an alarm condition, wherein the network enabled alarm audio verification test unit initiates the test communications with the displaced alarm forwarding system via a test port of the displaced alarm forwarding system reserved for testing purposes in response to a user input into an input device, wherein, when the displaced alarm forwarding system receives the test communications from the network enabled alarm audio verification test unit via the test port, the displaced alarm forwarding system abstains from forwarding the test communications received via the test port to the monitoring station, wherein the monitoring system control device transmits a verbal message comprising a first plurality of message packets to the displaced alarm forwarding system via the test port, wherein, when the displaced alarm forwarding system receives the first plurality of message packets from the monitoring system control device via the test port, the displaced alarm forwarding system retransmits the verbal message comprising a second plurality of message packets to the monitoring system control device, and wherein, when the monitoring system control device receives the second plurality of message packets from the displaced alarm forwarding system, the monitoring system control device determines whether the first plurality of message packets substantially matches the second plurality of message packets to verify audio quality.

2. The apparatus as in claim 1 wherein the network enabled alarm audio verification test unit communicates wirelessly via a network with the displaced alarm forwarding system.

3. The apparatus as in claim 2 wherein the monitoring system control device audibly outputs the verbal message after receiving the second plurality of message packets.

4. The apparatus as in claim 2 wherein the network comprises the Internet.

5. The apparatus as in claim 2 wherein the displaced alarm forwarding system includes a signaling and call setup port and a real-time audio streaming port.

6. The apparatus as in claim 5 further comprising an address translation router located between the monitoring system control device and the network.

7. The apparatus as in claim 6 wherein the displaced alarm forwarding system includes a STUN server and an associated port.

8. A method comprising:

providing a regional monitoring system that responds to an alarm condition in a region;

providing an audio alarm verification test unit that is associated with the regional monitoring system;

transmitting a verification test message from the audio alarm verification test unit to a displaced alarm forwarding system remotely located from the regional monitoring system via a test port of the displaced alarm forwarding system reserved for testing purposes in response to a user input into an input device;

when the displaced alarm forwarding system receives the test communications from the audio alarm verification test unit via the test port, abstaining from forwarding the verification test message received via the test port from the displaced alarm forwarding system to a monitoring station that monitors the regional monitoring system for the alarm condition;

transmitting a verbal message comprising a first plurality of message packets from the regional monitoring system to the displaced alarm forwarding system via the test port;

when the displaced alarm forwarding system receives the first plurality of message packets from the regional monitoring system via the test port, retransmitting the verbal message comprising a second plurality of message packets from the displaced alarm forwarding system to the regional monitoring system; and when the regional monitoring system receives the second plurality of message packets from the displaced alarm forwarding system, determining whether the first plurality of message packets substantially matches the second plurality of message packets to verify audio quality.

9. The method as in claim 8 further comprising presenting the verbal message audibly at the regional monitoring system.

10. A system comprising:

a regional monitoring system with a local system control panel; and circuitry at the regional monitoring system to provide verbal audio verification testing, wherein the verbal audio verification testing is implemented without causing an alarm condition, wherein test audio feedback is provided at the local system control panel, wherein the regional monitoring system communicates with a displaced alarm forwarding system remotely located from the regional monitoring system via a test port of the displaced alarm forwarding system reserved for testing purposes during the verbal audio verification testing, wherein, when the displaced alarm forwarding system receives any messages via the test port during the verbal audio verification testing, the displaced alarm forwarding system abstains from forwarding the messages received via the test port during the verbal audio verification testing to a monitoring station that monitors the regional monitoring system for an alarm condition wherein the regional monitoring system transmits a verbal message comprising a first plurality of message packets to the displaced alarm forwarding system via the test port, wherein, when the displaced alarm forwarding system receives the first plurality of message packets from the regional monitoring system, the displaced alarm forwarding system retransmits the verbal message comprising a second plurality of message packets to the regional monitoring system, and wherein, when the regional monitoring system receives the second plurality of message packets, the circuitry determines whether the first plurality of message packets substantially matches the second plurality of message packets to verify audio quality.

11. The system as in claim 10 wherein the test port comprises a communications set-up port, an address providing port, and a streaming audio port.

12. The system as in claim 11 wherein the regional monitoring system communicates with the communications set-up port to establish an audio communications path.

13. The system as in claim 12 wherein the local system control panel transmits the verbal message via the streaming audio port to the displaced alarm forwarding system, and wherein the displaced alarm forwarding system returns the verbal message to the regional monitoring system via the streaming audio port.

14. The system as in claim 13 wherein, responsive to the first plurality of message packets substantially matching the second plurality of message packets, the regional monitoring system audibly presents the verbal message via the local system control panel.

15. The system as in claim 10 wherein the displaced alarm forwarding system includes a multiple ported communications server.

* * * * *